US005474690A

United States Patent [19]

Wahl et al.

[11] Patent Number: 5,474,690

[45] **Date of Patent: * Dec. 12, 1995**

[54] CONCENTRATED BIODEGRADABLE QUATERNARY AMMONIUM FABRIC SOFTENER COMPOSITIONS CONTAINING INTERMEDIATE IODINE VALUE FATTY ACID CHAINS

[75] Inventors: Errol H. Wahl, Cincinnati; Dennis R. Bacon, Milford; Ellen S. Baker, Cincinnati, all of Ohio; Jean-Francois Bodet, Newcastle Upon Tyne, Great Britain; Hugo J. M. Demeyere, Merchtem, Belgium; John C. Severns, West Chester, Ohio; Michael P. Siklosi, Cincinnati, Ohio; Alice M. Vogel, Middletown, Ohio; Jeffrey W. Watson, Cincinnati, Ohio

[73] Assignee: The Procter & Gamble Company, Cincinnati, Ohio

[ * ] Notice: The portion of the term of this patent subsequent to Nov. 29, 2011, has been disclaimed.

[21] Appl. No.: 337,914

[22] Filed: Nov. 14, 1994

[51] Int. Cl.[6] ..... D06M 13/46

[52] U.S. Cl. ..... 252/8.8; 252/8.6; 252/8.9

[58] Field of Search ..... 252/8.6, 8.8, 8.9

[56] References Cited

U.S. PATENT DOCUMENTS

| | | | |
|---|---|---|---|
| 3,904,533 | 9/1975 | Neiditch et al. | 252/8.8 |
| 3,915,867 | 10/1975 | Kang et al. | 252/8.8 |
| 4,137,180 | 1/1979 | Naik et al. | 252/8.8 |
| 4,401,578 | 8/1983 | Verbruggen | 252/8.8 |
| 4,454,049 | 6/1984 | MacGilp et al. | 252/8.8 |
| 4,456,554 | 6/1984 | Walz et al. | 260/403 |
| 4,756,850 | 7/1988 | Nayar | 252/547 |
| 4,767,547 | 8/1988 | Staathof | 252/8.8 |
| 4,789,491 | 12/1988 | Chang et al. | 252/8.75 |
| 4,808,321 | 2/1989 | Staathof | 252/8.8 |
| 4,844,823 | 7/1989 | Jacques et al. | 252/8.8 |
| 4,874,554 | 10/1989 | Lange et al. | 260/404 |
| 4,885,102 | 12/1989 | Yamamura et al. | 252/8.8 |
| 4,915,854 | 4/1990 | Mao et al. | 252/8.8 |
| 4,923,642 | 5/1990 | Rutzen et al. | 260/404 |
| 4,937,008 | 6/1990 | Yamamura et al. | 252/8.8 |
| 5,023,003 | 6/1991 | Yamamura et al. | 252/8.8 |
| 5,019,280 | 5/1991 | Caswell et al. | 252/8.8 |
| 5,066,414 | 11/1991 | Chang | 252/8.8 |
| 5,133,885 | 7/1992 | Contor et al. | 252/8.6 |
| 5,368,756 | 11/1994 | Vogel et al. | 252/8.8 |

FOREIGN PATENT DOCUMENTS

| | | |
|---|---|---|
| 9002886A | 8/1991 | Brazil . |
| 2021322A1 | 1/1991 | Canada . |
| 013780 | 8/1980 | European Pat. Off. . |
| 0052517A1 | 5/1982 | European Pat. Off. . |
| 122140A2 | 4/1983 | European Pat. Off. . |
| 0079746A2 | 5/1983 | European Pat. Off. . |
| 122141A2 | 10/1984 | European Pat. Off. . |
| 240727A2 | 10/1987 | European Pat. Off. . |
| 243735A2 | 11/1987 | European Pat. Off. . |
| 284036A2 | 9/1988 | European Pat. Off. . |
| 336267A2 | 10/1989 | European Pat. Off. . |
| 370675A2 | 5/1990 | European Pat. Off. . |
| 0404471 | 12/1990 | European Pat. Off. . |
| 0409504A2 | 1/1991 | European Pat. Off. . |
| 409502A2 | 1/1991 | European Pat. Off. . |
| 0423894A2 | 4/1991 | European Pat. Off. . |
| 462806A2 | 12/1991 | European Pat. Off. . |
| 0479608A2 | 4/1992 | European Pat. Off. . |
| 0507478A1 | 10/1992 | European Pat. Off. . |
| 3904754A1 | 8/1989 | Germany . |
| 4004294A1 | 8/1991 | Germany . |

(List continued on next page.)

OTHER PUBLICATIONS

A. M. Schwartz et al., "Surface Active Agents—Their Chemistry and Technology," 1949, Interscience Publishers, Inc., N.Y., pp. 180–185. [no month].

R. Puchta, "Cationic Surfactants in Laundry Detergents and Laundry Aftertreatment Aids," Feb. 1984, JAOCS, vol. 61, No. 2, pp. 367–376.

R. R. Egan, "Cationic Surfact Active Agents as Fabric Softeners," Jan. 1978, vol. 55, JAOCS, pp. 118–121.

M. J. Schick, "Micelle Formation in Mixtures of . . . and Cationic Detergents," vol. 43, JAOCS, pp. 681–682. ]no date].

*Primary Examiner*—Anthony Green
*Attorney, Agent, or Firm*—Robert B. Aylor

[57] ABSTRACT

The present invention relates to stable, homogeneous, preferably concentrated, aqueous liquid textile treatment compositions that contain biodegradable diester quaternary ammonium compounds of the formula:

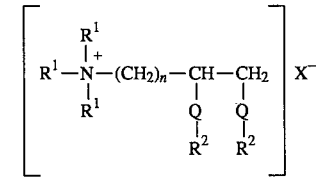

wherein each Q is —O—(O)C— or —C(O)—O—;

n is 1 to 4;

each $R^1$ substituent is a short chain $C_1$–$C_6$ alkyl group, benzyl group or mixtures thereof;

each $R^2$ is a long chain $C_{11}$–$C_{21}$hydrocarbyl, or substituted hydrocarbyl substituent and the counterion, $X^-$, can be any softener-compatible anion;

wherein the biodegradable quaternary ammonium fabric softening compound is derived from $C_{11}$–$C_{21}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups is less than about 65% by weight, the aqueous compositions being stable without nonionic viscosity modifiers when the concentration is less than or equal to 13%.

33 Claims, No Drawings

FOREIGN PATENT DOCUMENTS

| | | |
|---|---|---|
| 4015849A | 11/1991 | Germany . |
| 63/223099 | 9/1988 | Japan . |
| 1-229877 | 9/1989 | Japan . |
| 2-113095 | 4/1990 | Japan . |
| 2-139480 | 5/1990 | Japan . |
| 2-169769 | 6/1990 | Japan . |
| 4-41773 | 2/1992 | Japan . |
| 4-333667 | 11/1992 | Japan . |
| 5-98571 | 4/1993 | Japan . |
| WO89/11527 | 11/1989 | WIPO . |
| WO89/11522 | 11/1989 | WIPO . |
| WO91/01295 | 2/1991 | WIPO . |
| WO91/12364 | 8/1991 | WIPO . |
| 91/17974 | 11/1991 | WIPO . |
| 93/17085 | 9/1993 | WIPO . |
| 93/21291 | 10/1993 | WIPO . |
| 94/10285 | 5/1994 | WIPO . |

CONCENTRATED BIODEGRADABLE QUATERNARY AMMONIUM FABRIC SOFTENER COMPOSITIONS CONTAINING INTERMEDIATE IODINE VALUE FATTY ACID CHAINS

TECHNICAL FIELD

The present invention relates to stable, homogeneous, preferably concentrated, aqueous liquid textile treatment compositions. In particular, it especially relates to textile softening compositions for use in the rinse cycle of a textile laundering operation to provide excellent fabric softening/static control benefits, the compositions being characterized by excellent storage and viscosity stability, as well as biodegradability.

BACKGROUND OF THE INVENTION

The art discloses many problems associated with formulating and preparing stable liquid fabric conditioning formulations.

For example Jap. Pat. Application 63-194316, Kao, filed Nov. 21, 1988, teaches certain biodegradable quaternary ammonium compounds having $C_{12}$ to $C_{22}$ alkyl chains with unsaturation and a cis/trans ratio of 25/75 to 90/10. Compounds of the present invention are not specifically disclosed.

U.S. Pat. No. 4,767,547, Straathof et al., issued Aug. 30, 1988, teaches compositions containing either diester or monoester quaternary ammonium compounds where the nitrogen has either one, two, or three methyl groups, stabilized by maintaining a critical low pH of from 2.5 to 4.2. This reference teaches that unsaturation may improve rewettability properties to treated fabrics.

U.S. Pat. No. 5,066,414, Chang, issued Nov. 19, 1991, teaches compositions containing mixtures of quaternary ammonium salts containing at least one ester linkage, nonionic surfactant such as a linear alkoxylated alcohol, and liquid carrier for improved stability and dispersibility.

E.P. Appln. 409,502, Tandela et al., published Jan. 23, 1991, discloses compositions comprising ester quaternary ammonium compounds with a fatty acid material or its salt for stability of dispersions.

E.P. Appln. 243,735, Nusslein et al., published Nov. 4, 1987, discloses sorbitan ester plus diester quaternary ammonium compounds to improve dispersibility of concentrated dispersions.

E.P. Appln. 240,727, Nusslein et al., published Oct. 14, 1987, teaches diester quaternary ammonium compounds with soaps or fatty acids for improved dispersibility in water.

Jap. Pat. Appln. 4-333,667, published Nov. 20, 1992, teaches liquid softener compositions containing diester quaternary ammonium compounds having a total saturated:unsaturated ratio in the ester alkyl groups of 2:98 to 30:70.

All of the above patents and patent applications are incorporated herein by reference.

Unfortunately, all of the above approaches to improve the concentratability and/or dispersibility of diester quaternary ammonium compounds in aqueous rinse added fabric softener compositions have various shortcomings. For example, some of the above compositions require additional ingredients which increase cost and/or decrease softening performance of the composition, etc.

SUMMARY OF THE INVENTION

The present invention provides biodegradable textile softening compositions with excellent concentratability, static control, softening, and storage stability of the concentrated aqueous compositions. In addition, these compositions provide these benefits under worldwide laundering conditions and minimize the use of extraneous ingredients for stability and static control to decrease the environmental chemical load.

Specifically, the present invention relates to a stable, homogeneous, fabric softening composition comprising:

(A) from about 5% to about 50% of a biodegradable quaternary ammonium fabric softening compound;

(B) from about 0% to about 5% of a dispersibility modifier selected from the group consisting of:

1. single-long-chain, $C_{10}$–$C_{22}$ alkyl, cationic surfactant;
2. nonionic surfactant with at least 8 ethoxy moieties;
3. amine oxide;
4. $C_{12}$–$C_{25}$ fatty acid; and
5. mixtures thereof, (C) from about 0% to about 2% of a stabilizer; and (D) aqueous liquid carrier;

wherein the biodegradable quaternary ammonium fabric softening compound has the formula:

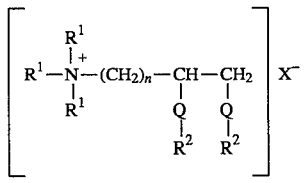

wherein each Q is —O—(O)C— or —C(O)—O—;

n is 1 to 4;

each $R^1$ is a short chain $C_1$–$C_6$ alkyl group, benzyl group and mixtures thereof, each $R^2$ is a $C_{11}$–$C_{21}$ hydrocarbyl, or substituted hydrocarbyl substituent; and the counterion, $X^-$, is any softener-compatible anion;

wherein the biodegradable quaternary ammonium fabric softening compound is derived from $C_{11}$–$C_{21}$ fatty acyl groups having an Iodine Value of from greater than about 5 to less than about 100, a cis/trans isomer weight ratio of greater than about 0/70 when the Iodine Value is less than about 25, the level of unsaturation of the fatty acyl groups is less than about 65% by weight, the aqueous compositions being stable without nonionic viscosity modifiers when the concentration is less than or equal to 13%; and wherein the dispersibility modifier affects the composition's viscosity, dispersibility, or both.

The compositions of the present invention contain quaternary ammonium compounds wherein the fatty acyl groups have an Iodine Value greater than about 5 to less than about 100, a cis/trans isomer weight ratio of greater than about 30/70 when the Iodine Value is less than about 25, the level of unsaturation being less than about 65% by weight, wherein said compounds are capable of forming concentrated aqueous compositions with concentrations greater than about 13% by weight at an Iodine Value of greater than about 10 without viscosity modifiers other than normal polar organic solvents present in the raw material of the compound or added electrolyte, and wherein any fatty acyl groups from tallow are preferably modified.

The compositions can be aqueous liquids, preferably concentrated, containing from about 5% to about 50%, preferably from about 15% to about 40%, more preferably from about 15% to about 35%, and even more preferably from about 15% to about 26% by weight of the composition, of said biodegradable, preferably diester, softening compound.

These compositions provide adequate usage concentration in the rinse cycle, e.g., from about 10 to about 1,000 ppm, preferably from about 50 to about 500 ppm, of total active ingredient.

All percentages and ratios used herein are by weight of the total composition and all measurements are made at 25° C., unless otherwise designated. The invention hereof can comprise, consist of, or consist essentially of, the essential as well as optional ingredients and components described herein.

DETAILED DESCRIPTION OF THE INVENTION

The present invention provides biodegradable textile softening compositions with excellent concentratability, static control, softening, and storage stability of the concentrated aqueous compositions. In addition, these compositions provide these benefits under worldwide laundering conditions and minimize the use of extraneous ingredients for stability and static control to decrease the environmental chemical load.

Specifically, the present invention relates to a stable, homogeneous, aqueous, fabric softening composition comprising:

(A) from about 5% to about 50% of a biodegradable quaternary ammonium fabric softening compound;

(B) from about 0% to about 5% of dispersibility modifier selected from the group consisting of:

1. single-long-chain, $C_{10}$–$C_{22}$ alkyl, cationic surfactant;
2. nonionic surfactant with at least 8 ethoxy moieties;
3. amine oxide;
4. $C_{12}$–$C_{25}$ fatty acid; and
5. mixtures thereof;

(C) from about 0% to about 2% of a stabilizer; and (D) aqueous liquid carrier;

wherein the biodegradable quaternary ammonium fabric softening compound has the formula:

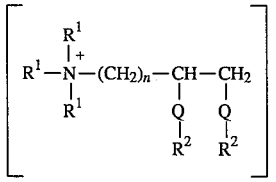

wherein each Q is —O—(O)C— or —C(O)—O—;

n is 1 to 4;

each $R^1$ is a short chain $C_1$–$C_6$ alkyl group, benzyl group and mixtures thereof;

each $R^2$ is a $C_{11}$–$C_{21}$ hydrocarbyl, or substituted hydrocarbyl substituent; and the counterion, $X^-$, can be any softener-compatible anion; wherein the biodegradable quaternary ammonium fabric softening compound is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups is less than about 65% by weight, the aqueous compositions being stable without nonionic viscosity modifiers when the concentration is less than or equal to 13%; and wherein the dispersibility modifier affects the composition's viscosity, dispersibility, or both.

The compositions of the present invention contain quaternary ammonium compounds wherein the fatty acyl groups have an Iodine Value of from greater than about 5 to less than about 100, a cis/trans isomer weight ratio of greater than about 30/70 when the Iodine Value is less than about 25, the level of unsaturation being less than about 65% by weight, wherein said compounds are capable of forming concentrated aqueous compositions with concentrations greater than about 13% by weight at an Iodine Value of greater than about 10 without viscosity modifiers other than normal polar organic solvents present in the raw material of the compound or added electrolyte, and wherein any fatty acyl groups from tallow are preferably modified.

The compositions can be aqueous liquids, preferably concentrated, containing from about 5% to about 50%, preferably from about 15% to about 40%, more preferably from about 15% to about 35%, and even more preferably from about 15% to about 26% by weight of the composition, of said biodegradable, preferably diester, softening compound.

These compositions provide adequate usage concentration in the rinse cycle, e.g., from about 10 to about 1,000 ppm, preferably from about 50 to about 500 ppm, of total active ingredient.

(A) Quaternary Ammonium Compound

The present invention relates to compositions containing biodegradable quaternary ammonium compound(s) as an essential component having the formula:

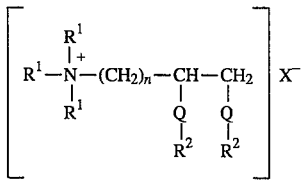

wherein each Q is —O—(O)C— or —C(O)—O—;

n is 1 to 4;

each $R^1$ is a short chain $C_1$–$C_6$, preferably $C_1$–$C_3$, alkyl group, e.g., methyl (most preferred), ethyl, propyl, and the like, benzyl group, and mixtures thereof;

each $R^2$ is a long chain, at least partially unsaturated (Iodine Value of greater than about 5 to less than about 100), $C_{11}$–$C_{21}$ hydrocarbyl, or substituted hydrocarbyl substituent, preferably wherein $R^2$ is derived from a fatty acid having at least about 90% $C_{16}$–$C_{18}$ chain-length, and the counterion, $X^-$, can be any softener-compatible anion, for example, chloride, bromide, methylsulfate, formate, sulfate, nitrate and the like.

Biodegradable quaternary ammonium compounds prepared with fully saturated acyl groups are rapidly biodegradable and excellent softeners. However, it has now been discovered that compounds prepared with at least partially unsaturated acyl groups have many advantages (i.e., concentratability and good storage viscosity) and are highly acceptable for consumer products when certain conditions are met.

Variables that must be adjusted to obtain the benefits of using unsaturated acyl groups include the Iodine Value of the starting fatty acids; the cis/trans isomer weight ratios of the fatty acyl groups; and the odor of fatty acid and/or the biodegradable quaternary ammonium compound(s). Any reference to Iodine Value hereinafter refers to the Iodine Value of fatty acyl (or alkyl) groups and not to the resulting biodegradable quaternary ammonium compound(s).

When the Iodine Value of the fatty acyl groups is above about 20, the biodegradable quaternary ammonium compound(s) provides excellent antistatic effect. Antistatic effects are especially important where the fabrics are dried in a tumble dryer, and/or where synthetic materials which generate static are used. Maximum static control occurs with an Iodine Value of greater than about 20 to less than about 100, preferably greater than about 40, e.g. from about 40 to about 65. When fully saturated biodegradable quaternary ammonium compound(s) compositions are used, relatively poor static control results. Also, as discussed hereinafter, concentratability increases as Iodine Value increases. The benefits of concentratability include: use of less packaging material; use of less organic solvents, especially volatile organic solvents; use of less concentration aids which may add nothing to performance; etc.

As the Iodine Value is raised, there is a potential for odor problems. Surprisingly, some highly desirable, readily available sources of fatty acids such as tallow, possess odors that remain with the biodegradable quaternary ammonium compound(s) despite the chemical and mechanical processing steps which convert the raw tallow to finished biodegradable quaternary ammonium compound(s). Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior concentratability and/or performance which was not heretofore recognized. For example, biodegradable quaternary ammonium compound(s) containing unsaturated fatty acyl groups can be concentrated above about 13% without the need for additional concentration aids, especially surfactant concentration aids as discussed hereinafter.

Biodegradable quaternary ammonium compound(s) derived from highly unsaturated fatty acyl groups, i.e., fatty acyl groups having a total unsaturation above about 65% by weight, do not provide any additional improvement in antistatic performance. They may, however, provide other benefits such as improved water absorbency of the fabrics. In general, an Iodine Value range of from about 40 to about 65 is preferred for concentratability, maximization of fatty acyl sources, excellent softness, static control, etc.

Highly concentrated aqueous dispersions of these diester compounds can gel and/or thicken during low (4° C.) temperature storage. Diester compounds made from only unsaturated fatty acids minimizes this problem but additionally are more likely to cause malodor formation. Surprisingly, compositions from these diester compounds made from fatty acids having an Iodine Value of from about 5 to about 25, preferably from about 10 to about 25, more preferably from about 15 to about 20, and a cis/trans isomer weight ratio of from greater than about 30/70, preferably greater than about 50/50, more preferably greater than about 70/30, are storage stable at low temperature with minimal odor formation. These cis/trans isomer weight ratios provide optimal concentratability at these Iodine Value ranges. If the Iodine Value range is above about 25, the ratio of cis to trans isomers is less important unless higher concentrations are needed. For any Iodine Value, the concentration that will be stable in an aqueous composition will depend on the criteria for stability (e.g., stable down to about 5° C.; stable down to 0° C.; doesn't gel; gels at low temperature but recovers on heating to ambient temperature, etc.) and the other ingredients present.

Generally, hydrogenation of fatty acids to reduce polyunsaturation and to lower Iodine Values to insure good color and improve odor and odor stability leads to a high degree of trans configuration in the molecules. Therefore, diester compounds derived from fatty acyl groups having low Iodine Values can be made by mixing fully hydrogenated fatty acid with touch hydrogenated fatty acid at a ratio which provides an Iodine Value of from about 5 to about 25. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc. Touch hardened fatty acid with high cis/trans isomer weight ratios is available commercially (i.e., Radiacid® 406 from Fina Chemicals).

It has also been found that for good chemical stability of the dieslet quaternary compound in molten storage, the moisture level in the raw material composition, which typically contains from about 80% to about 92% of the diester quaternary compound, must be controlled and minimized. The moisture level (water) is preferably less than about 1%, more preferably less than about 0.5% by weight of the molten composition. The remainder of the raw material composition is compatible organic solvent, especially alcohol, e.g., ethyl, isopropyl, propylene glycol, ethylene glycol, glycerine, etc., mixtures thereof and/or propylene carbonate. Storage temperatures should be kept as low as possible and still maintain a fluid material, ideally in the range of from about 49° C. to about 66° C. The optimum storage temperature for stability and fluidity depends on the specific Iodine Value of the fatty acid used to make the diester quaternary compound and the level/type of solvent selected. It is important to maintain good molten storage stability to provide a commercially feasible raw material that will not degrade noticeably in the normal transportation/storage/handling of the material in manufacturing operations.

A color and odor stable, molten fabric softening raw material composition comprises:

(A) from about 80% to about 92% of biodegradable quaternary ammonium fabric softening compound;

(B) from about 8% to about 18% compatible organic solvent; and (C) from about 0% to about 2% of stabilizer;

wherein the raw material contains less than about 1%, preferably less than about 0.5%, by weight of the raw material composition, of water; and wherein the biodegradable quaternary ammonium fabric softening compound has the formula:

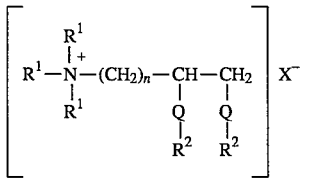

wherein each Q is —O—(O)C— or —C(O)—O—;

n is 1 to 4;

each $R^1$ is a short chain $C_1$–$C_6$ alkyl group, benzyl group or mixtures thereof, each $R^2$ is a long chain $C_{11}$–$C_{21}$ hydrocarbyl, or substituted hydrocarbyl substituent; and the counterion, $X^-$, is any softener-compatible anion;

wherein the compound is derived from $C_{11}$–$C_{22}$ fatty acyl groups having an Iodine Value of from greater than about 20 to less than about 100 for optimum static control, and the level of unsaturation of the fatty acyl groups is less than about 65% by weight.

The above raw material composition is preferably stored under conditions where the oxygen level is less than 0.1%, e.g., it is desirable to store the raw material composition under nitrogen. The molten raw material composition's storage temperature is preferably from about 49° C. to about 66° C. Also, the raw material composition preferably comprises stabilizer selected from the group consisting of: from about 0.01% to about 0.2% reductive agent stabilizer; from about 0.035% to about 0.1% antioxidant stabilizer; and mixtures thereof.

Compositions of the present invention contain from about 5% to about 50%, preferably from about 15% to about 40% more preferably from about 15% to about 35%, and even more preferably from about 15% to about 26%, by weight of the composition, of the biodegradable quaternary ammonium compound.

Substituents $R^1$ and $R^2$ can optionally be substituted with various groups such as alkoxyl or hydroxyl groups. The preferred compounds can be considered to be diester variations of ditallow dimethyl ammonium chloride (DTDMAC), which is a widely used fabric softener. At least 80% of the biodegradable quaternary ammonium compound(s) is in the diester form, and from 0% to about 20%, preferably less than about 10%, more preferably less than about 5%, can be biodegradable quaternary ammonium compound(s) monoester (e.g., only one —Q—$R^2$ group).

As used herein, when the diester is specified, it will include the monoester that is normally present. For softening, under no/low detergent carry-over laundry Conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the biodegradable quaternary ammonium compound(s).

Biodegradable quaternary ammonium compound(s) compounds prepared with saturated acyl groups, i.e., having an Iodine Value of about 5 or less, can be partially substituted for the biodegradable quaternary ammonium compound(s) of the present invention prepared with unsaturated acyl groups. This partial substitution can decrease the odor associated with unsaturated biodegradable quaternary ammonium compound(s). The ratio of unsaturated to saturated acyl groups is from about 0.2:1 to about 8:1, preferably from about 0.25:1 to about 4:1, most preferably from about 0.3:1 to about 1.5:1.

Preferred compounds of the present invention include those having the formula:

$$(CH_3)_3N^+—CH_2CH[OC(O)R^2]—CH_2\ (OC(O)R^2)Cl^-$$

where —C(O)$R^2$ is derived from partially hydrogenated tallow or modified tallow having the characteristics set forth herein.

It is especially surprising that careful pH control can noticeably improve product odor stability of compositions using unsaturated biodegradable quaternary ammonium compound(s).

In addition, since the foregoing compounds (diesters) are somewhat labile to hydrolysis, they should be handled rather carefully when used to formulate the compositions herein. For example, stable liquid compositions herein are formulated at a pH in the range of from about 2 to about 5, preferably from about 2 to about 4.5, more preferably from about 2 to about 4. For best product odor stability, when the Iodine Value is greater that about 25, the pH is from about 2.8 to about 3.5, especially for "unscented" (no perfume) or lightly scented products. The pH can be adjusted by the addition of a Bronsted acid. The pH ranges above are determined without prior dilution of the composition with water.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, and citric acids.

(B) Optional Viscosity/Dispersibility Modifiers

As stated before, relatively concentrated compositions of the unsaturated biodegradable quaternary ammonium compound(s) can be prepared that are stable without the addition of concentration aids. However, the compositions of the present invention require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are high and Iodine Value is low.

I. Surfactant Concentration Aids

The surfactant concentration aids are typically selected from the group consisting of (1) single long chain alkyl cationic surfactants; (2) nonionic surfactants; (3) amine oxides; (4) fatty acids; or (5) mixtures thereof. The levels of these aids are described below.

(1) The Single-Long-Chain Alkyl Cationic Surfactant

The mono-long-chain-alkyl (water-soluble) cationic surfactants are at a level of from 0% to about 15%, preferably from about 0.5% to about 10%, the total single-long-chain cationic surfactant being at least at an effective level. Such mono-long-chain-alkyl cationic surfactants useful in the present invention are, preferably, quaternary ammonium salts of the general formula:

$$[R^2N^+R_3]X^-$$

wherein the $R^2$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from about 0.1% to about 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

The ranges above represent the amount of the single-long-chain-alkyl cationic surfactant which is added to the composition of the present invention. The ranges do not include the amount of monoester which is already present in component (A) , the diester quaternary ammonium compound, the total present being at least at an effective level.

The long chain group, $R^2$, of the single-long-chain-alkyl cationic surfactant, typically contains an alkylene group having from about 10 to about 22 carbon atoms, preferably from about 12 to about 18 carbon atoms. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, any acid (preferably a mineral or polycarboxylic acid) which is added to keep the ester groups stable will also keep the amine protonated in the compositions and preferably protonated during the rinse so that the amine has a cationic group. The composition is buffered (pH from about 2 to about 5, preferably from about 2 to about 4) to maintain an appropriate, effective charge density in the aqueous liquid concentrate product and upon further dilution e.g., to form a less concentrated product and/or upon addition to the rinse cycle of a laundry process.

It will be understood that the main function of the water-soluble cationic surfactant is to lower the viscosity and/or increase the dispersibility of the diester softener and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts useful in the present invention have the general formula:

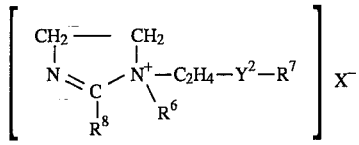

wherein $Y^2$ is —C(O)—O—, —O—(O)C—, —C(O)—N(RS), or —N(RS)—C(O)— in which $R^5$ is hydrogen or a $C_1$–$C_4$ alkyl group; $R^6$ is a $C_1$–$C_4$ alkyl group; each R and $R^8$ are independently selected from R and $R^2$ as defined hereinbefore for the single-longchain cationic surfactant with only one being $R^2$.

Some alkyl pyridinium salts useful in the present invention have the general formula:

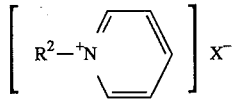

wherein $R^2$ and $X^-$ are as defined above for the single-long-chain alkyl cationic surfactant. A typical material of this type is cetyl pyridinium chloride.

(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc.

Any of the alkoxylated materials of the particular type described hereinafter can be used as the nonionic surfactant. In general terms, the nonionics herein, when used alone, are at a level of from 0% to about 5%, preferably from about 0.1% to about 5%, more preferably from about 0.2% to about 3% by weight of the composition. Suitable compounds are substantially water-soluble surfactants of the general formula:

$$R^2—H—(C_2H_4O)_z—C_2H_4OH$$

wherein $R^2$ for both solid and liquid compositions is selected frown the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically—O—, —C(O)O—, —C(O)N(R)—, or —C(O)N(R)R—, in which $R^2$, and R, when present, have the meanings given hereinbefore, and/or R can be hydrogen, and z is at least about 8, preferably at least about 10–11. Performance and, usually, stability of the softener composition decrease when fewer ethoxylate groups are present. The nonionic surfactants herein are characterized by an HLB (hydrophiliclipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers are preferred over the other modifiers disclosed herein for compositions with higher levels of perfume. Examples of nonionic surfactants follow. The nonionic surfactants of this invention are not limited to these examples. In the examples, the integer defines the number of ethoxyl (EO) groups in the molecule.

a. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n—$C_{18}$EO(10); and n—$C_{10}$EO(11). The ethoxylates of mixed natural or synthetic alcohols in the "tallow" chain length range are also useful herein. Specific examples of such materials include tallowalcohol-EO(11), tallowalcohol-EO(18), and tallowalcohol-EO(25).

b. Strait-Chain, Secondary Alcohol Alkoxylates

The deca-, undeca-, dodeca-, tetradeca-, pentadeca-, octadeca-, and nonadecaethoxylates of 3-hexadecanol, 2-octadecanol, 4-eicosanol, and 5-eicosanol having and HLB within the range recited herein are useful viscosity/dispersibility modifiers in the context of this invention. Exemplary ethoxylated secondary alcohols useful herein as the viscosity/dispersibility modifiers of the compositions are: 2—$C_{16}$EO(11); 2—$C_{20}$EO(11); and 2—$C_{16}$EO(14).

c. Alkyl Phenol Alkoxylates

As in the case of the alcohol alkoxylates, the hexa- through octadecaethoxylates of alkylated phenols, particularly monohydric alkylphenols, having an HLB within the range recited herein are useful as the viscosity/dispersibility modifiers of the instant compositions. The hexa- through octadeca-ethoxylates of p- tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

d. Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

e. Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(3) Amine Oxides

Suitable amine oxides include those with one alkyl or hydroxyalkyl moiety of about 8 to about 28 carbon atoms, preferably from about 8 to about 16 carbon atoms, and two alkyl moieties selected from the group consisting of alkyl groups and hydroxyalkyl groups with about 1 to about 3 carbon atoms.

The amine oxides are at a level of from 0% to about 5%, preferably from about 0.25% to about 2%, the total amine oxide present at least at an effective level. _Examples include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

(4) Fatty Acids

Suitable fatty acids include those containing from about 12 to about 25, preferably from about 13 to about 22, more preferably from about 16 to about 20, total carbon atoms, with the fatty moiety containing from about 10 to about 22, preferably from about 10 to about 18, more preferably from about 10 to about 14 (mid cut), carbon atoms. The shorter moiety contains from about 1 to about 4, preferably from about 1 to about 2 carbon atoms.

Fatty acids are present at the levels outlined above for amine oxides. Fatty acids are preferred concentration aids for those compositions which require a concentration aid and contain perfume.

II. Electrolyte Concentration Aids

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include l-lysine monohydrochloride and 1,5-diammonium 2-methyl pentane dihydrochloride.

(C) Optional Stabilizers

Stabilizers can be present in the compositions of the present invention. The term "stabilizer," as used herein, includes antioxidants, especially those that scavenge free radicals, and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. Use of antioxidants and reductive agent stabilizers is especially critical for unscented or low scent products (no or low perfume). The antioxidants are preferably present in an effective amount to scavenge free radicals.

Examples of antioxidants that can be added to the compositions of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzenesulfonic acid/sodium salt, and DTPA®, available from Aldrich with a chemical name of diethylenetriaminepentaacetic acid. The chemical names and CAS numbers for some of the above stabilizers are listed in Table II below.

TABLE II

| Antioxidant | CAS No. | Chemical Name used in Code of Federal Regulations |
|---|---|---|
| Irganox ® 1010 | 6683-19-8 | Tetrakis [methylene(3,5-di-tert-butyl-4 hydroxyhydrocinnamate)] methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnammamide |
| Irganox ® B 1171 | 31570-04-4<br>23128-74-7 | 1:1 Blend of Irganox ® 1098 and Irgafos ® 168 |
| Irganox ® 1425 | 65140-91-2 | Calcium bis[monoethyl(3,5-di-tert-butyl-4-hydroxybenzyl) phosphonate] |
| Irganox ® 3114 | 27676-62-6 | 1,3,5-Tris(3,5-di-tert-butyl-4-hydroxybenzyl)-s-triazine-2,4,6-(1H, 3H, 5H)trione |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

2. Chelants

The present compositions can also comprise chelants (which as used herein also includes materials effective not only for binding metals in solution but also those effective for precipitating metals from solution) alone or in combination with the free radical scavenging antioxidant materials as discussed hereinbefore. Preferred chelants for use herein include citric acid, citrate salts (e.g., trisodium citrate), isopropyl citrate, Dequest® 2010 [available from Monsanto with a chemical name of 1-hydroxyethylidene-1, 1-diphosphonic acid (etidronic acid)], TironR (available from Kodak with a chemical name of 4,5-dihydroxy-m-benzene-sulfonic acid/sodium salt), DTPA® (available from Aldrich with a chemical name of diethylenetriaminepentaacetic acid), ethylene diamine-N, N'-disuccinic acid (EDDS, preferably the S, S isomer), 8-hydroxyquinoline, sodium dithiocarbamate, sodium tetraphenylboron, ammonium nitrosophenyl hydroxylamine, and mixtures thereof. Most preferred are citric acid and citrate salts.

Compositions herein preferably comprise a chelant in an amount of from about 10 ppm to about 0.5%, preferably from about 25 ppm to about 1000 ppm, by weight of the composition.

(D) Liquid Carrier

The liquid carrier employed in the instant compositions is preferably at least primarily water due to its low cost relative availability, safety, and environmental compatibility. The level of water in the liquid carrier is at least about 50%, preferably at least about 60%, by weight of the carrier. The level of liquid carrier is less than about 70, preferably less than about 65, more preferably less than about 50. Mixtures of water and low molecular weight, e.g., <100, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

(E) Other Optional Ingredients (1) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred soil release agents are polymers of the generic formula (I):

$$X-(OCH_2CH_2)n-(O-\overset{O}{\overset{\|}{C}}-R^1-\overset{O}{\overset{\|}{C}}-O-R^2)u-(O-\overset{O}{\overset{\|}{C}}-R^1-\overset{O}{\overset{\|}{C}}-O)-(CH_2CH_2O)n-X \qquad (I)$$

in which X can be any suitable capping group, with each X being selected from the group consisting of H, and alkyl or acyl groups containing from about 1 to about 4 carbon atoms, preferably methyl. n is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5 -pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds. Inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Pat. Application 185,427, Gosselink, published Jun. 25, 1986, incorporated herein by reference.

(2) Optional Bacteriocides

Examples of bacteriocides that can be used in the compositions of this invention are parabens, especially methyl, glutaraldehyde, formaldehyde, 2-bromo-2-nitropropane-1, 3-diol sold by Inolex Chemicals under the trade name Bronopol®, and a mixture of 5-chloro-2-methyl-4-isothiazoline-3-one and 2-methyl-4-isothiazoline-3-one sold by Rohm and Haas Company under the trade name Kathon® CG/ICP. Typical levels of bacteriocides used in the present compositions are from about 1 to about 2,000 ppm by weight of the composition, depending on the type of bacteriocide selected. Methyl paraben is especially effective for mold growth in aqueous fabric softening compositions with under 10% by weight of the diester compound.

(3) Other Optional Ingredients

The present invention can include other optional components conventionally used in textile treatment compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, anti-corrosion agents, antifoam agents, and the like. An especially preferred ingredient is cellulase. If cellulase is present, the optional stabilizing ingredients discussed hereinbefore are especially desirable.

The cellulase

The cellulase usable in the compositions herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of Humicola insolens (Humicola grisea vat. thermoidea), particularly by the Humicola strain DSM 1800, and cellulase 212-producing fungus belonging to the genus Aeromonas, and cellulase extracted from the hepatopanereas of a marine mullose (Dolabella Aurieula Solander).

The cellulase can be added in the form of a non-dusting granulate, e.g. "mammes" or "prills", or in the form of a liquid, e.g., one in which the cellulase is provided as a cellulase concentrate suspended in e.g. a nonionic surfactant or dissolved in an aqueous medium.

Preferred cellulases for use herein are characterized in that they provide at least 10% removal of immobilized radioactive labelled carboxymethyl-cellulose according to the $C^{14}$CMC-method described in EPA 350 098 (incorporated herein by reference in its entirety) at $25\times10^{-6}$% by weight of cellulase protein in the laundry test solution.

Most preferred cellulases are those as described in International Patent Is Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43kD cellulase derived from Humicola insolens, DSM 1800, or which is homologous to said 43kD endoglucanase.

The cellulases herein are preferably used in the fabric-conditioning compositions at a level equivalent to an activity from about 0.1 to about 125 CEVU/gram of composition [CEVU=Cellulase (equivalent) Viscosity Unit, as described, for example, in WO 91/13136, incorporated herein by reference in its entirety], and most preferably about 5 to about 100. Such levels of cellulase are selected to provide the herein preferred cellulase activity at a level such that the compositions deliver a fabric softening effective amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the compositions are used in the rinse cycle at a level to provide from about 1 CEVU's per liter rinse solution to about 50 CEVU's per liter rinse solution, more perferably from about 2 CEVU's per liter to about 30 CEVU's per liter, even more preferably from about 5 CEVU's per liter to about 25 CEVU's per liter, and most perferably from about 10 CEVU's per liter to about 20 CEVU's per liter.

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the liquid composition is typically from about 0.5% to about 10%, preferably from about 1% to about 5% by weight of the composition.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties [Tweens® ]are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20-50% mono-ester, 25-50% di-ester and 10–35% of tri- and tetraesters are preferred.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like.-In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono and/or diesters of the polyglycerol polyols are preferred, the fatty acyl groups typically being those described hereinbefore for the sorbitan and glycerol esters.

EXAMPLES

The following examples further describe and demonstrate embodiments on this scope of the present invention. The examples are given solely for the purpose of illustration and are not to be construed as limitations of the present invention, as many variations are possible without departing from the spirit and scope of the invention.

| Component | I Wt. % | II Wt. % |
|---|---|---|
| Diester Compound[1] | 22.0 | 8.67 |
| Hydrochloric Acid | 0.005 | 0.002 |
| Citric Acid | 0.005 | 0.002 |
| Liquitint ® Blue 65 Dye (1%) | 0.25 | 0.08 |
| Perfume | 1.35 | 0.40 |
| Irganox ® 3125 | 0.035 | 0.035 |
| Kathon ® (1.5%) | 0.02 | 0.02 |
| DC-2210 Antifoam (10%) | 0.15 | 0.15 |
| $CaCl_2$ Solution (15%) | 3.33 | 0.006 |
| DI Water | Balance | Balance |

[1]1,2-diacyloxy-3-trimethylammonium propane chloride where the acyloxy groups are derived from deodorized tallow fatty acids. The diester includes monoester at a weight ratio of 11:1 diester to monoester.

The above Example I composition is made by the following process:

1. Separately, heat the diester compound premix with the Irganox® 3125 and the water seat containing HCl, citric acid, and antifoam agent to 74°±2.7° C.; (Note: the citric acid can totally replace HCl, if desired);

2. Add the diester compound premix into the water seat over 5–6 minutes. During the injection, both mix (600–1,000 rpm) and mill (8,000 rpm with an IKA Ultra Turrax® T-50 Mill) the batch.

3. Add 500 ppm of $CaCl_2$ at approximately halfway through the injection.

4. Add 2,000 ppm $CaCl_2$ over 2–7 minutes (200–2,500 ppm/minute) with mixing at 800–1,000 rpm after premix injection is complete at about 66°–74° C.

5. Add perfume over 30 seconds at 63°–68° C.

6. Add dye and Kathon and mix for 30–60 seconds. Cool batch to 21°–27° C.

7. Add 2,500 ppm to 4,000 ppm $CaCl_2$ to cooled batch and mix.

The above Example II composition is made by the following process:

1. Separately, heat the diester compound premix with the Irganox® 3125 and the water seat containing HCl, citric acid, and antifoam agent to 74±2.7° C.; (Note: the citric acid can totally replace HCl, if desired);

2. Add the diester compound premix into the water seat over 2–3 minutes. During the injection, both mix (600–1,000 rpm) and mill (8,000 rpm with an IKA Ultra Turrax® T-50 Mill) the batch.

3. Add perfume over 15 seconds at 63°–68° C.

4. Add dye and Kathon® and mix for 30–60 seconds.

5. Add 9 ppm $CaCl_2$ and mix for 30–60 seconds.

6. Cool batch to 21°–27° C.

EXAMPLE III

Concentrated Diester Composition

| Component | Wt. % |
|---|---|
| Diester Compound[1] | 18.5 |
| PGMS[2] | 3.5 |
| Tallow alcohol ethoxylate (25) | 1.5 |
| Soil Release Polymer[3] | 0.33 |
| Silicone Antifoam | 0.019 |
| $CaCl_2$ | 0.29 |
| HCl | 0.08 |
| PEG 4000 | 0.60 |
| Minors (perfume, dye, etc.) | 1.00 |
| DI Water | Balance |

[1]1,2-diacyloxy-3-trimethylammonium propane chloride where the fatty acyl group is derived from fatty acids with an Iodine Value of 18 and a cis/trans isomer weight ratio of 70/30.
[2]Polyglycerol monostearate having a trade name of Radiasurf 7248.
[3]Copolymer of ethylene oxide and terephthalate with the generic soil release formula (I) wherein each X is methyl, each n is 40, u is 4, each $R^1$ is essentially 1,4-phenylene moieties, each $R^2$ is essentially ethylene, 1,2-propylene moieties, or mixtures thereof.

What is claimed is:

1. A stable, homogeneous, liquid fabric softening composition comprising:

(A) from about 5% to about 50% of biodegradable quaternary ammonium fabric softening compound;

(B) from about 0% to about 5% of dispersibility modifier selected from the group consisting of:

1. single-long-chain, $C_{10}$–$C_{22}$ alkyl, cationic surfactant;
2. nonionic surfactant with at least 8 ethoxy moieties;
3. amine oxide;
4. $C_{12}$–$C_{25}$ fatty acid; and
5. mixtures thereof;

(C) from about 0% to about 2% of stabilizer; and (D) aqueous liquid carrier;

wherein the biodegradable quaternary ammonium fabric softening compound has the formula:

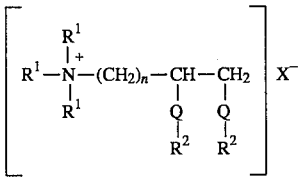

wherein each Q is —O—(O)C— or —C(O)—O—;

n is 1 to 4;

each $R^1$ is a short chain $C_1$–$C_6$ alkyl group, benzyl group or mixtures thereof each $R^2$ is a long chain $C_{11}$–$C_{21}$ hydrocarbyl, or substituted hydrocarbyl substituent; and the counterion, $X^-$, is any softener-compatible anion;

wherein the biodegradable quaternary ammonium fabric softening compound is derived from $C_{11}$–$C_{21}$ fatty acyl groups having: (a) an Iodine Value of from greater than about 5 to less than about 100; (b) a cis/trans isomer weight ratio of greater than about 30/70 when the Iodine Value is less than about 25; and (c) a level of unsaturation that is less than about 65% by weight; and wherein said compositions have certain inherent viscosity and dispersibility characteristics and the dispersibility modifier affects the composition's characteristics with respect to viscosity, dispersibility, or both.

2. The composition of claim 1 wherein the Iodine Value is from about 10 to about 65 and the cis/trans isomer weight ratio is greater than about 50/50 when the Iodine Value is less than about 25.

3. The composition of claim 2 wherein the Iodine Value is from about 20 to about 60 and the cis/trans isomer weight ratio is greater than about 70/30 when the Iodine Value is less than about 25.

4. The composition of claim 1 wherein $R^2$ is derived from a fatty acid having at least about 90% $C_{16}$–$C_{18}$ chainlength.

5. The composition of claim 4 wherein the Iodine Value is from about 10 to about 65 and the cis/trans isomer weight ratio is greater than about 50/50 when the Iodine Value is less than about 25.

6. The composition of claim 5 wherein the Iodine Value is from about 20 to about 60 and the cis/trans isomer weight ratio is greater than about 70/30 when the Iodine Value is less than about 25.

7. A stable, homogeneous, liquid fabric softening composition comprising:

(A) from about 5% to about 50% of biodegradable quaternary ammonium fabric softening compound;

(B) from about 0% to about 5% of dispersibility modifier selected from the group consisting of:

1. single-long-chain, $C_{10}$–$C_{22}$ alkyl, cationic surfactant;
2. nonionic surfactant with at least 8 ethoxy moieties;
3. amine oxide;
4. $C_{12}$–$C_{25}$ fatty acid; and
5. mixtures thereof;

(C) from about 0% to about 2% of stabilizer; and (D) liquid carrier;

wherein the biodegradable quaternary ammonium fabric softening compound has the formula:

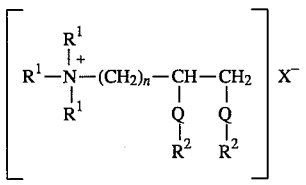

wherein each Q is —O—(O)C— or —C(O)—O—;

n is 1 to 4;

each $R^1$ is a short chain $C_1$–$C_6$ alkyl group, benzyl group or mixtures thereof;

each $R^2$ is a long chain $C_{11}$–$C_{21}$ hydrocarbyl, or substituted hydrocarbyl substituent; and the counterion, $X^-$, is any softener-compatible anion;

wherein the biodegradable quaternary ammonium fabric softening compound is derived from $C_{11}$–$C_{21}$ fatty acyl groups having: (a) an Iodine Value of from greater than about 20 to less than about 100 for optimum static control: (b) a cis/trans isomer weight ratio of greater than about 30/70 when the Iodine Value is less than about 25; and (c) a level of unsaturation that is less than about 65% by weight; and wherein said compositions have certain inherent viscosity and dispersibility characteristics and the dispersibility modifier affects the composition's characteristics with respect to viscosity, dispersibility, or both and wherein the aqueous composition is stable without nonionic viscosity modifiers when the concentration of biodegradable quaternary ammonium fabric softening compound (A) is less than, or equal to, 13%.

8. The composition of claim 7 wherein the Iodine Value is from about 20 to about 65.

9. The composition of claim 8 wherein the Iodine Value is from about 40 to about 65.

10. The composition of claim 7 wherein $R^2$ is derived from fatty acid having at least 90% $C_{16}$–$C_{18}$ chainlength.

11. The composition of claim 10 wherein the Iodine Value is from about 20 to about 65.

12. The composition of claim 11 wherein the Iodine Value is from about 40 to about 65.

13. The composition of claim 10 wherein the stabilizer is selected from the group consisting of: ascorbic acid; propyl gallate; ascorbic palmitate; butylated hydroxytoluene; tertiary butylhydroquinone; natural tocopherols; butylated hydroxyanisole; citric acid; $C_8$–$C_{22}$ esters of gallic acid; tetrakis methane; thiodiethylene bis(3,5-di-tert-butyl-4-hydroxyhydrocinnamate; N,N'-hexamethylene bis(3,5-di-tert-butyl-4-hydroxyhydroxin-nammamide; tris(2,4-di-tert-butyl-phenyl)phosphite; calcium bis; 1,3,5-tris(3,5-di-tert-butyl-4-hyroxybenzyl)-s-triazine-2,4,6-(1H, 3H, 5H) trione; 3,5-di-tert-butyl-4-hydroxy-hydrocinnamic acid triester with 1,3,5-tris(2-hydroxyethyl)-S-triazine-2,4,6-( 1H, 3H, 5H)-trione; and mixtures thereof.

14. The composition of claim 13 wherein the stabilizer is selected from the group consisting of: 1,3,5-tris(3,5-di-tert-butyl-4-hyroxybenzyl)-s-triazine-2,4,6-(1H, 3H, 5H) trione; 3,5 -di-tert-butyl-4-hydroxy-hydrocinnamic acid triester with 1,3,5-tris(2-hydroxyethyl)-S-triazine-2,4,6-(1H, 3H, 5H)-trione; and mixtures thereof.

15. The composition of claim 10 wherein the single-long-chain cationic surfactant partially comprises a monoester compound of the formula:

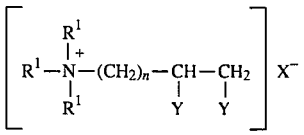

wherein one Y is —O—(O) C—$R^2$ or C(O)—O—$R^2$ and the other Y is $R^2$;

n is 1 to 4;

each $R^1$ is a short chain $C_1$–$C_6$ alkyl group, benzyl group, or mixtures thereof;

each $R^2$ is a longer chain $C_{11}$–$C_{21}$ hydrocarbyl, or substituted hydrocarbyl substituent; and the counterion $X^-$, is any softener-compatible anion;

wherein the weight ratio of the biodegradable quaternary ammonium fabric softening compound to the monoester compound is from about 13:1 to about 8:1.

16. A stable, homogeneous, liquid fabric softening composition comprising:

(A) from about 5% to about 50% of biodegradable quaternary ammonium fabric softening compound;

(B) from about 0% to about 5% of dispersibility modifier selected from the group consisting of:

1. single-long-chain, $C_{10}$–$C_{22}$ alkyl, cationic surfactant;
2. nonionic surfactant with at least 8 ethoxy moieties;
3. amine oxide;
4. $C_{12}$–$C_{25}$ fatty acid; and
5. mixtures thereof;

(C) from about 0% to about 2% of stabilizer; and (D) aqueous liquid carrier;

wherein the biodegradable quaternary ammonium fabric softening compound has the formula:

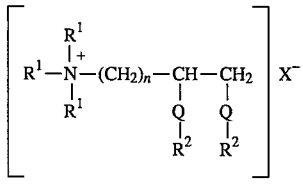

wherein each Q is —O—(O)C— or —C(O)—O—;

n is 1 to 4;

each $R^1$ is a short chain $C_1$–$C_6$ alkyl group, benzyl group or mixtures thereof;

each $R^2$ is a long chain $C_{11}$–$C_{21}$ hydrocarbyl, or substituted hydrocarbyl substituent; and the counterion, $X^-$, is any softener-compatible anion;

wherein the biodegradable quaternary ammonium fabric softening compound is derived from $C_{11}$–$C_{21}$ fatty acyl groups having: (a) an Iodine Value of from greater than about 5 to less than about 25 for optimum low temperature stability; (b) a cis/trans isomer weight ratio which is greater than about 30/70; and (c) a level of unsaturation that is less than about 65% by weight; and wherein said compositions have certain inherent viscosity and dispersibility characteristics and the dispersibility modifier affects the composition's characteristics with respect to viscosity, dispersibility, or both and wherein the pH of the aqueous composition is from about 2 to about 5.

17. The composition of claim 16 wherein the Iodine Value is from about 10 to about 25 and the cis/trans isomer weight ratio is greater than about 50/50.

18. The composition of claim 17 wherein the Iodine Value is from about 15 to about 20 and the cis/trans isomer weight ratio is greater than about 70/30.

19. The composition of claim 18 wherein the fatty acyl group has a polyunsaturation content of less than about 1%.

20. The composition of claim 19 wherein the single-long-chain cationic surfactant comprises a monoester compound of the formula:

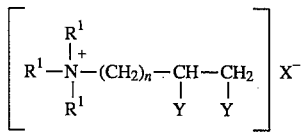

wherein one Y is —O—(O)C—$R^2$ or C(O)—O—$R^2$ and the other Y is $R^2$;

n is 1 to 4;

each $R^1$ is a short chain $C_1$–$C_6$ alkyl group, benzyl group, or mixtures thereof;

each $R^2$ is a longer chain $C_{11}$–$C_{21}$ hydrocarbyl, or substituted hydrocarbyl substituent; and the counterion $X^-$, is any softener-compatible anion;

wherein the weight ratio of the biodegradable quaternary ammonium fabric softening compound to the monoester compound is from about 40:1 to about 8:1.

21. The composition of claim 16 wherein $R^2$ is derived from fatty acid having at least 90% $C_{16}$–$C_{18}$ chainlength.

22. The composition of claim 21 wherein the Iodine Value is from about 10 to about 25 and the cis/trans isomer weight ratio is greater than about 50/50.

23. The composition of claim 22 wherein the Iodine Value is from about 15 to about 20 and the cis/trans isomer weight ratio is greater than about 70/30.

24. The composition of claim 23 wherein the fatty acyl group has a polyunsaturation content of less than about 1%.

25. A color and odor stable, molten fabric softening raw material composition comprising:

(A) from about 80% to about 92% of a biodegradable quaternary ammonium fabric softening compound;

(B) from about 8% to about 18% compatible organic solvent; and (C) from about 0% to about 2% of a stabilizer;

wherein the raw material contains less than about 1% by weight of the raw material composition of water; and wherein the biodegradable quaternary ammonium fabric softening compound has the formula:

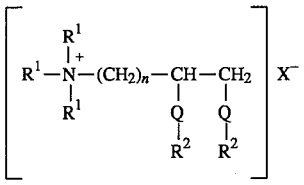

wherein each Q is —O—(O)C— or —C(O)—O—;

n is 1 to 4;

each $R^1$ is a short chain $C_1$ –$C_6$ alkyl group, benzyl group or mixtures thereof;

each $R^2$ is a long chain $C_{11}$–$C_{21}$ hydrocarbyl, or substituted hydrocarbyl substituent; and the counterion, $X^-$, is any softener-compatible anion;

wherein the compound is derived from $C_{11}$–$C_{22}$ fatty acyl groups having an Iodine Value of from greater than about 20 to less than about 100 for optimum static control, and a level of unsaturation of the fatty acyl groups that is less than about 65% by weight.

26. The raw material composition of claim 25 wherein said raw material composition has a water level that is less than about 0.5% by weight of the raw material composition.

27. The raw material composition of claim 26 wherein the raw material composition is stored under a nitrogen atmosphere.

28. The raw material composition of claim 27 wherein said nitrogen atmosphere has an oxygen level of less than 0.1%.

29. The molten raw material composition of claim 28 having a storage temperature that is from about 49° C. to about 66° C.

30. The raw material of claim 25 wherein said stabilizer (C) is selected from the group consisting of: from about 0.01% to about 0.2% reductive agent stabilizer, from about 0.035% to about 0.1% antioxidant stabilizer, and mixtures thereof.

31. The raw material composition of claim 30 wherein the stabilizer is selected from the group consisting of: ascorbic acid; propyl gallate; ascorbic acid; butylated hydroxytoluene; tertiary butylhydroquinone; natural tocopherols; butylated hydroxyanisole; sodium borohydride; hypophosphorous acid; isopropyl citrate; $C_8C_{C22}$ esters of gallic acid; tetrakis methane; thiodiethylene bis(3,5-di-tert-butyl-4-hydroxyhydrocinnamate; N,N'-hexamethylene bis(3,5-di-tert-butyl-4-hydroxyhydroxin-nammamide; tris(2,4-di-tert-butyl-phenyl)phosphite; calcium bis; 1,3,5-tris(3,5-di-tert-butyl-4-hyroxybenzyl)-s-triazine-2,4,6 -(1H, 3H, 5H) trione; 3,5-di-tert-butyl-4-hydroxy-hydrocinnamic acid triester with 1,3,5-tris(2-hydroxyethyl)-S-triazine-2,4,6 -(1H, 3H, 5H)-trione; tris(2,4-di-tert-butyl-phenyl)phosphite; and mixtures thereof.

32. The raw material composition of claim 31 wherein the compatible organic solvent level is from about 12% to about 16% by weight of the composition.

33. The raw material composition of claim 32 wherein the compatible organic solvent is selected from the group consisting of ethanol, isopropyl alcohol, propylene glycol, ethylene glycol, propylene carbonate and mixtures thereof.

* * * * *